US006536919B1

(12) United States Patent
Johnson et al.

(10) Patent No.: US 6,536,919 B1
(45) Date of Patent: Mar. 25, 2003

(54) LIGHT FIXTURE WITH TOOL-LESS COMPONENT MODULE MOUNTING STRUCTURE

(75) Inventors: David M. Johnson, Hendersonville, NC (US); Lee Belknap, Hendersonville, NC (US); Reed A. Bradford, Hendersonville, NC (US); James H. Toney, Jr., Canton, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/703,143

(22) Filed: Oct. 31, 2000

(51) Int. Cl.[7] ..... F21V 17/10

(52) U.S. Cl. ..... 362/265; 362/221; 362/368; 362/374; 362/375; 248/222.11; 248/222.52

(58) Field of Search ..... 362/310, 368, 362/374, 433, 436, 45, 221, 265, 375; 248/544, 689, 690, 691, 606, 220.21, 222.11, 222.51, 222.52, 218; 220/3.8, 3.9, 3.92

(56) References Cited

U.S. PATENT DOCUMENTS

| | | | | | |
|---|---|---|---|---|---|
| 2,510,745 | A | * | 6/1950 | Kilgore | 174/67 |
| 3,858,755 | A | * | 1/1975 | Tellen | 137/371 |
| 4,019,044 | A | | 4/1977 | Kelly et al. | |
| 4,156,902 | A | | 5/1979 | Wandler | |
| 4,220,986 | A | | 9/1980 | Matteo et al. | |
| 4,374,407 | A | | 2/1983 | Drost et al. | |
| 4,414,616 | A | | 11/1983 | de Vos et al. | |
| 4,488,205 | A | * | 12/1984 | Quiogue | 362/217 |
| 4,791,539 | A | | 12/1988 | Ewing | |
| 4,937,718 | A | * | 6/1990 | Murray | 362/368 |
| 4,979,634 | A | * | 12/1990 | Begley | 16/267 |
| 5,136,493 | A | | 8/1992 | Straus et al. | |
| 5,180,074 | A | * | 1/1993 | Bowman et al. | 220/3.3 |
| 5,243,508 | A | | 9/1993 | Ewing et al. | |
| 5,351,174 | A | | 9/1994 | Ewing | |
| 5,680,718 | A | | 10/1997 | Ratcliffe et al. | |
| 5,725,293 | A | * | 3/1998 | Wilkening et al. | 211/116 |
| 5,746,507 | A | | 5/1998 | Lee | |
| 5,762,224 | A | * | 6/1998 | Benn et al. | 220/210 |
| 5,927,843 | A | * | 7/1999 | Haugaard et al. | 248/220.21 |
| 5,941,632 | A | | 8/1999 | Wedell et al. | |
| 5,997,158 | A | | 12/1999 | Fischer et al. | |
| 6,059,424 | A | * | 5/2000 | Kotloff | 362/220 |
| 6,276,818 | B1 | * | 8/2001 | Wang | 292/5 |

* cited by examiner

*Primary Examiner*—Sandra O'Shea
*Assistant Examiner*—Ismael Negron
(74) *Attorney, Agent, or Firm*—Fay, Sharpe, Fagan, Minnich & McKee, LLP

(57) ABSTRACT

A light fixture assembly (100) having an electrical component module (110) which may be mounted to the fixture housing (120) without tools and without requiring additional hardware or space upon the electrical component module (110). The electrical component module (110) is capable of being held in a substantially stationary position by at least one bracket (255), at least one stop (270), and a releasable catch (265).

20 Claims, 10 Drawing Sheets

LIGHT FIXTURE WITH TOOL-LESS COMPONENT MODULE MOUNTING STRUCTURE

BACKGROUND OF THE INVENTION

The invention relates to a mounting system, and in particular, to a mounting system for an electrical component module in a fixture housing.

The electrical components of a light fixture, e.g., a high intensity discharge (HID) ballast, are mounted directly to the fixture housing. These electrical components, however, require routine maintenance and/or periodic replacement. It is known in the art to mount electrical components on sheet metal or diecast trays before placing them in the fixture housing in order to make performing routine maintenance and/or periodic replacement easier. One problem associated with some of the current mounting approaches is that the maintenance and/or replacement of electrical components necessitates tools. While this issue has been addressed in the prior art, the prior art solutions have created other problems. In particular, one tool-less approach requires additional hardware and space on the module tray. This assembly requires handles attached to the mounting module.

Accordingly, a need exists for an alternative means for module mounting.

BRIEF SUMMARY OF THE INVENTION

The present invention is embodied in a light fixture assembly that has an electrical component module which may be mounted to the fixture housing without tools and without requiring additional hardware or space upon the module tray. The electrical component module is capable of being held in a substantially stationary position. The light fixture housing includes at least one bracket attached to the fixture housing, at least one stop opposed to the bracket, and a releasable catch. The spacing between the bracket and the stop is sufficient to accommodate fitted placement of the module tray in a substantially stationary position. Further, a pivot element may be used to provide additional support for the electrical component module.

This mounting system has a number of advantages over the prior art. No additional hardware is needed to mount the module tray in the fixture housing.

Another advantage resides in the ease with which the module tray may be mounted since no tools are required.

Yet another advantage is realized since the module tray will not fall out of the fixture housing even when the light fixture assembly is faced downward.

DETAILED DESCRIPTION OF THE INVENTION

Figure 1:
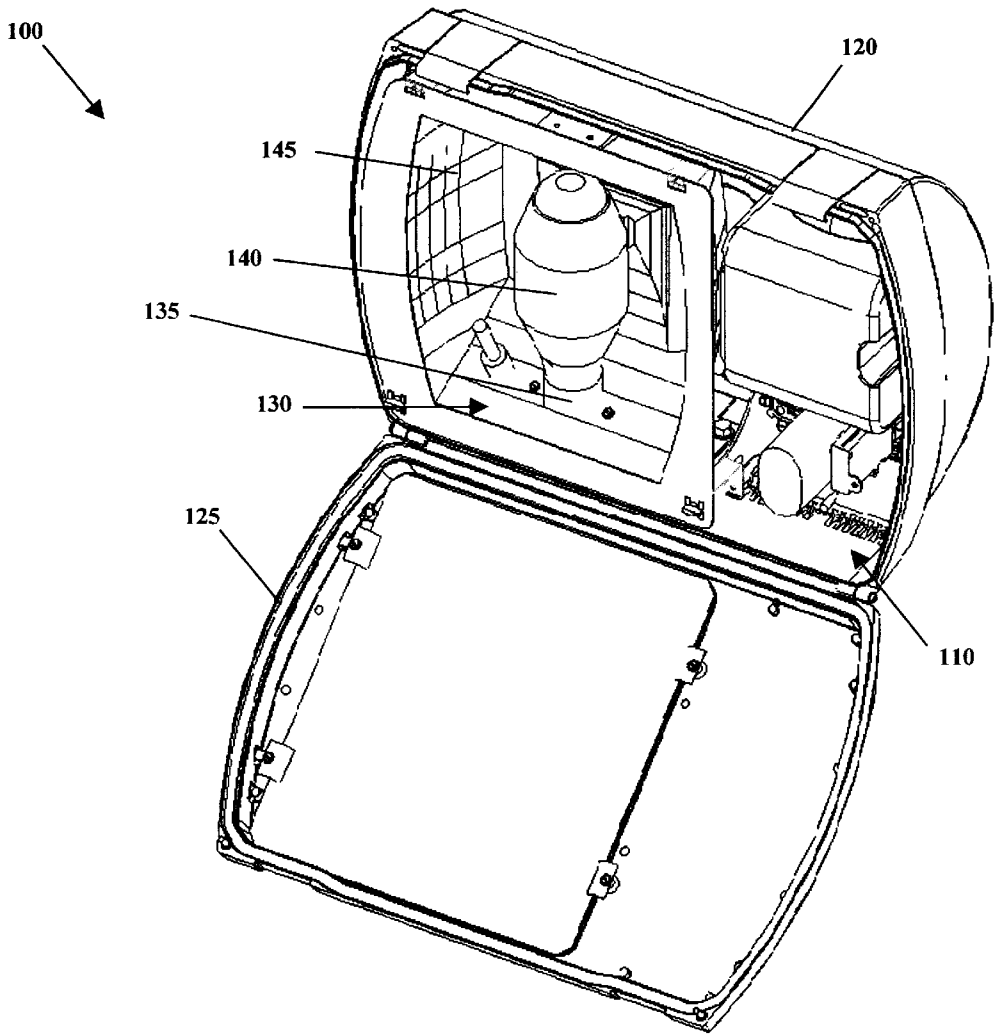
FIG. 1 is an exemplary embodiment of a light fixture assembly dying the present invention.

With reference to the Figures, several embodiments of the present invention will now be shown and described. Like reference numerals are used to designate the same components. FIG. 1 depicts an exemplary embodiment of a light fixture assembly 100 embodying the present invention. The light fixture assembly 100 includes an electrical component module 110, a fixture housing 120, and an optical assembly 130.

The fixture housing 120 is a conventional lighting fixture housing manufactured of a suitable material. While the fixture housing 120 is preferably die-cast aluminum, other materials, such as sheet metal or plastic, may be used. The front portion of the fixture housing 120 is typically a hinged door 125 made of a suitable material such as die-cast aluminum with glass. The interior of the fixture housing 120 contains the optical assembly 130 and the electrical component module 110. The optical assembly 130 may include a lamp socket 135 for a lamp 140. The lamp 140 may be of any suitable type, such as an HID. The optical assembly 130 may also include reflective walls 145, such as a reflector for reflecting light emitted by the lamp 140. The optical assembly 130 is located next to the electrical component module 110. However, the optical assembly 130 may also be located in front of the electrical component module 110.

Figure 2:
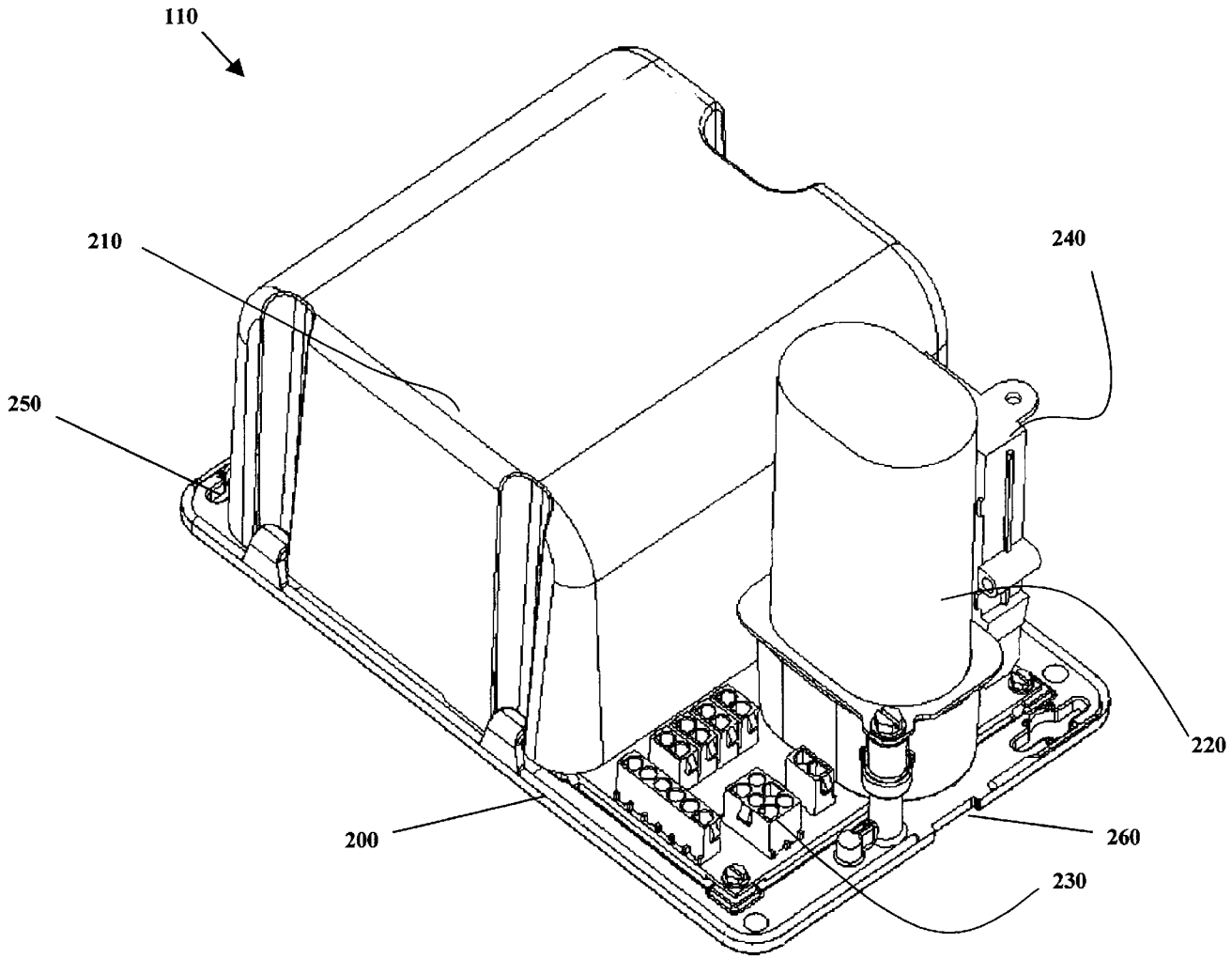
FIG. 2 shows the electrical component module contained in the light fixture assembly of FIG. 1.

As seen in FIG. 2, the module tray 200 of the electrical component module 110 is formed of a suitable material such as sheet metal, die-cast aluminum or plastic. The electrical components attached to the module tray 200 may include a ballast (not shown) contained within a ballast housing 210, a capacitor 220, and an interconnection means 230. The interconnection means 230 provides the electrical interface between the lamp socket 135 and the other electrical components contained on the module tray 200. The interconnection means 230 may be a circuit board for a wireless configuration. The interconnection means 230 may also be suitable wiring for a conventional configuration. Module tray 200 may also hold an ignitor 240. The ignitor 240 is typically used for high pressure sodium and pulse metal halide HID lamps.

Figure 3:
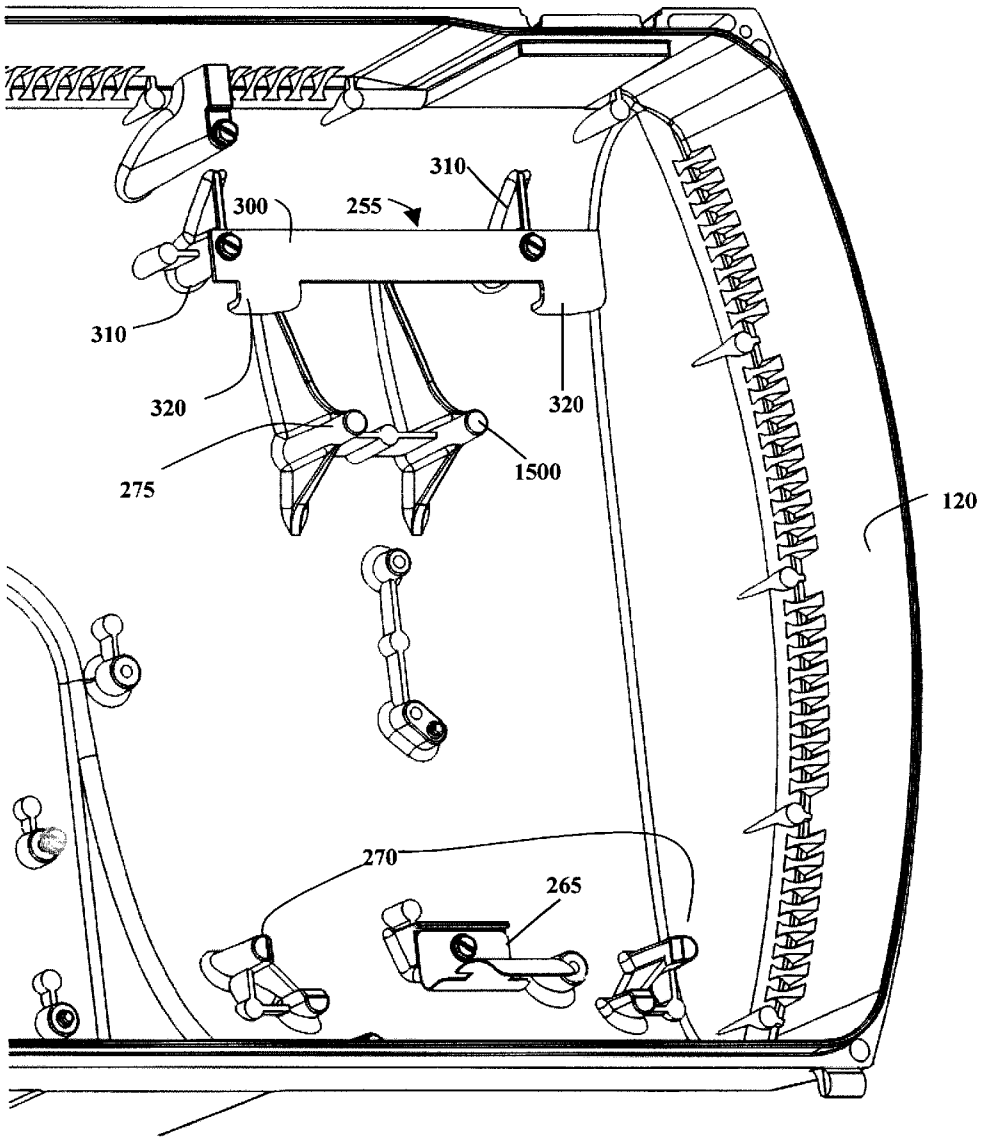
FIG. 3 is a front view of the light fixture assembly of FIG. 1, with the electrical component module removed.

The exemplary module tray 200 has two bracket cavities 250 (only one shown) for receiving a bracket 255 as seen in FIG. 3. The module tray 200 also has a notch 260 on one side end for receiving a releasable catch 265 as seen in FIG. 3. Both the bracket 255 and the releasable catch 265 are discussed in further detail below.

Figure 4:
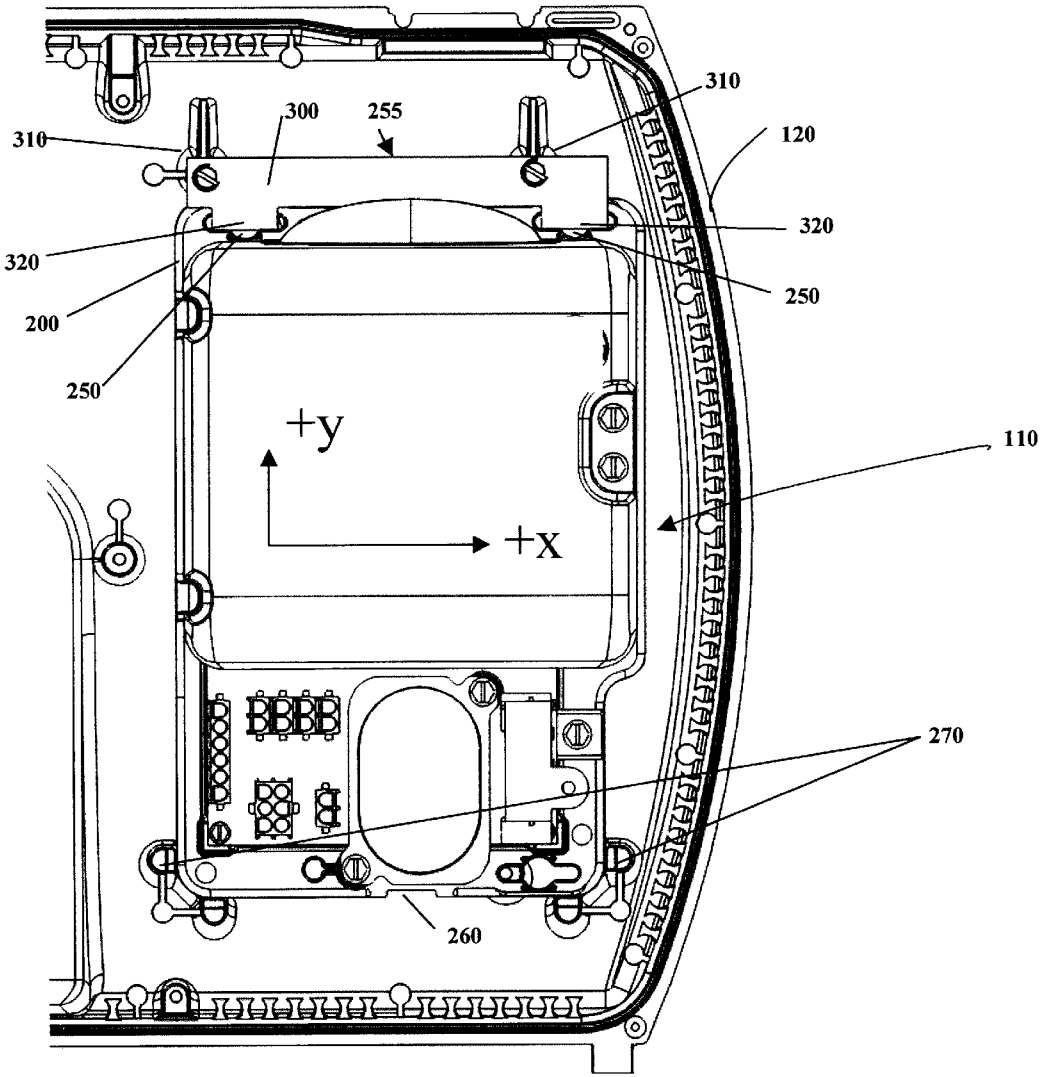
FIG. 4 is a front view of the light fixture assembly of FIG. 1, with the electrical component module assembled.
Figure 5:
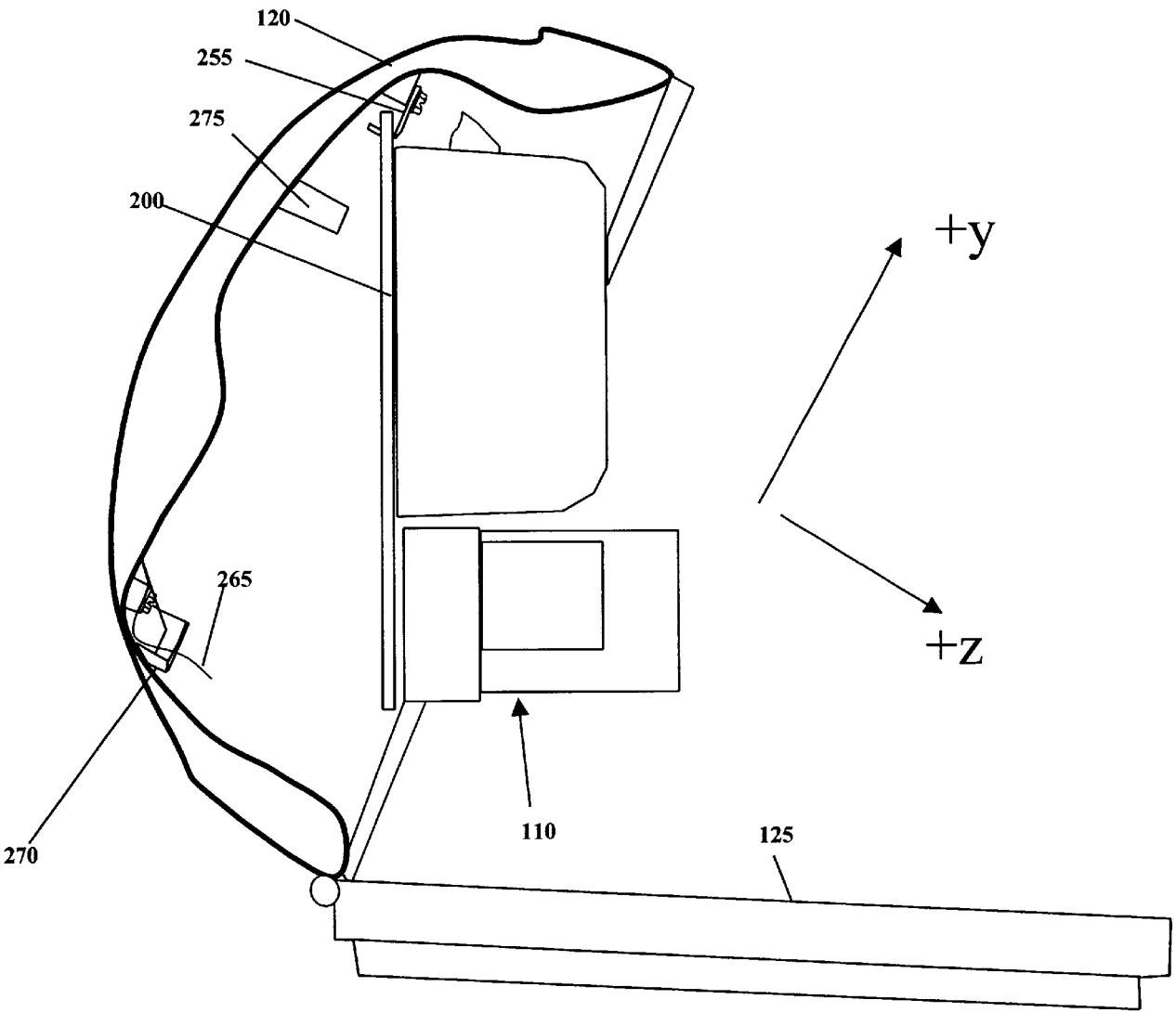
FIG. 5 is a side view of the light fixture assembly of FIG. 1, with the electrical component module assembly partially assembled.

Referring to FIGS. 3–5, the area within the interior of the fixture housing 120 where the electrical component module 110 is to be placed contains the bracket 255, the releasable catch 265, and two stops 270, in the exemplary embodiment. This area of the fixture housing 120 also preferably includes at least one pivot element 275.

The exemplary embodiment of the module tray 200 has two bracket cavities 250 for receiving the bracket 255. One segment 300 of the bracket 255 is attached to bracket protrusions 310 using any number of attachment means, such as screws. The bracket protrusions 310 may be separate components extending from the fixture housing 120. The bracket protrusions 310 may also be molded into the fixture housing 120. Segments 320 of the bracket 255 not attached to the bracket protrusions 310 preferably face downward into the fixture housing 120. Segments 320 of the bracket 255 not attached to the bracket protrusions 310 should be of a length greater than the width of a side end of the module tray 200 so that the bracket 255 will extend through mating cavities 250 in the module tray 200.

Figure 7:
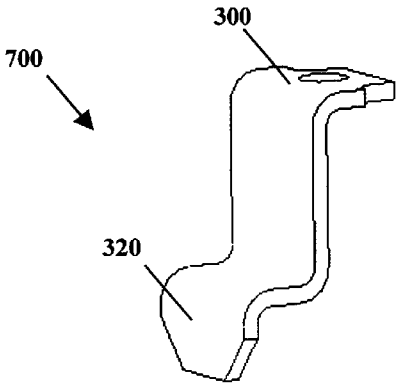
FIG. 7 depicts an alternative embodiment of the bracket used in the light fixture assembly of FIG. 1.
Figure 13:
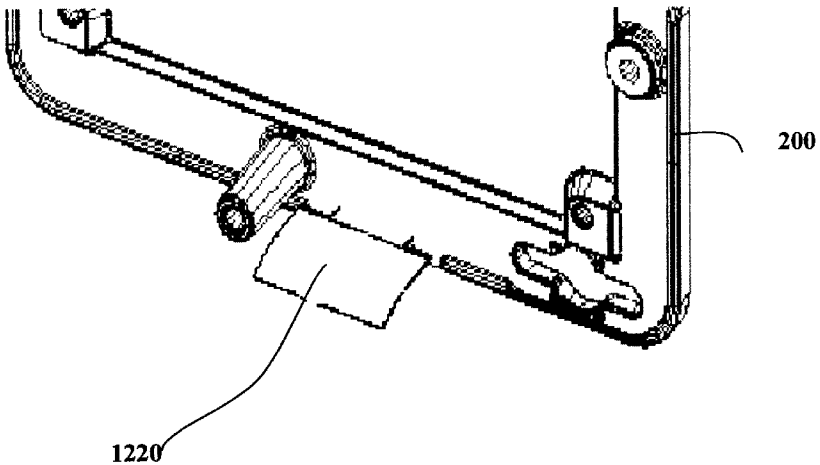
FIG. 12 and FIG. 13 depict the releasable catch used in the light fixture assembly of FIG. 1.
Figure 6:
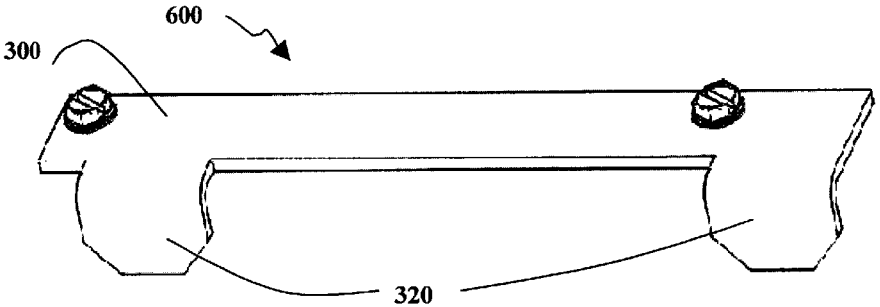
FIG. 6 depicts the bracket used in the light fixture assembly of FIG. 1.
Figure 12:
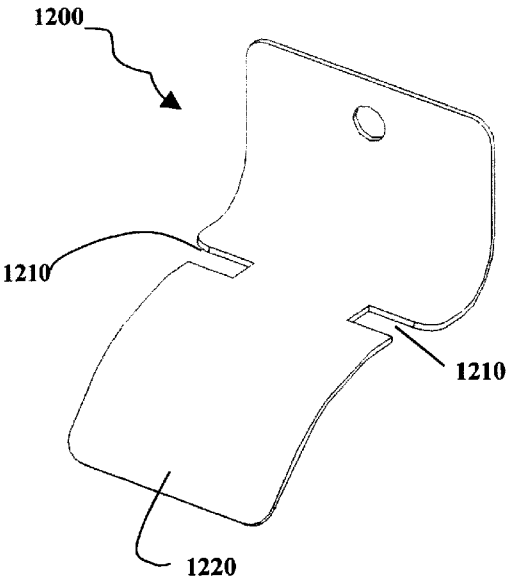

The bracket 255 may be a variety of shapes but is preferably L-shaped 600 or Z-shaped 700, as shown in FIGS. 6 and 7. When the electrical component module 110 is secure in the fixture housing 120, the bracket 255 prevents substantial movement in the X, Y and positive Z-directions.

In a further embodiment of the module tray 200, the bracket cavities 250 are keyholed so that electrical component module 110 may be mounted with a variety of attachment means, such as screws or other fasteners (not shown). Large holes in the center of the bracket cavities 250 (not shown) allow the electrical component module 110 to be removed without completely removing the fasteners.

Returning to FIGS. 3–5, the fixture housing 120 of the exemplary light fixture assembly 100 contains the two stops 270 opposite the bracket 255. The spacing therebetween should be sufficient to accommodate fitted placement of edges of the module tray 200 against the stops 270. The stops may be substantially the same shape as or at least frame the mating edges of the module tray 200. The stops 270 may be separate components attached to the fixture housing 120 or protrusions extending from the fixture housing 120. The stops 270 may further be recessed portions of the fixture housing 120. The stops 270 prevent movement of the module tray 200 in the X-direction and negative Y and Z directions.

Figure 9:
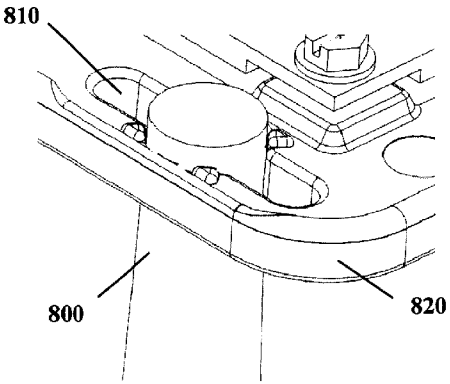
FIG. 8 and FIG. 9 depict an additional embodiment of a stop which may be used in the light fixture assembly of FIG. 1.
Figure 8:
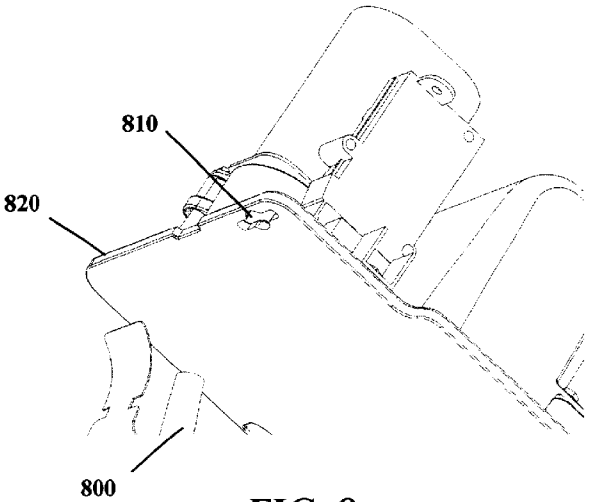

FIGS. 8 and 9 show one alternative embodiment of the stop 270 as a shaped protrusion. In FIGS. 8 and 9, a cylinder 800 is used instead of stop 270. Other shaped protrusions may include any number of geometric shapes, such as a square, rectangle, cross, and cone. The cylinder 800 extends from the fixture housing 120 through a mating cavity 810 in module tray 820. This prevents movement in the X, Y and negative Z directions.

Figure 11:
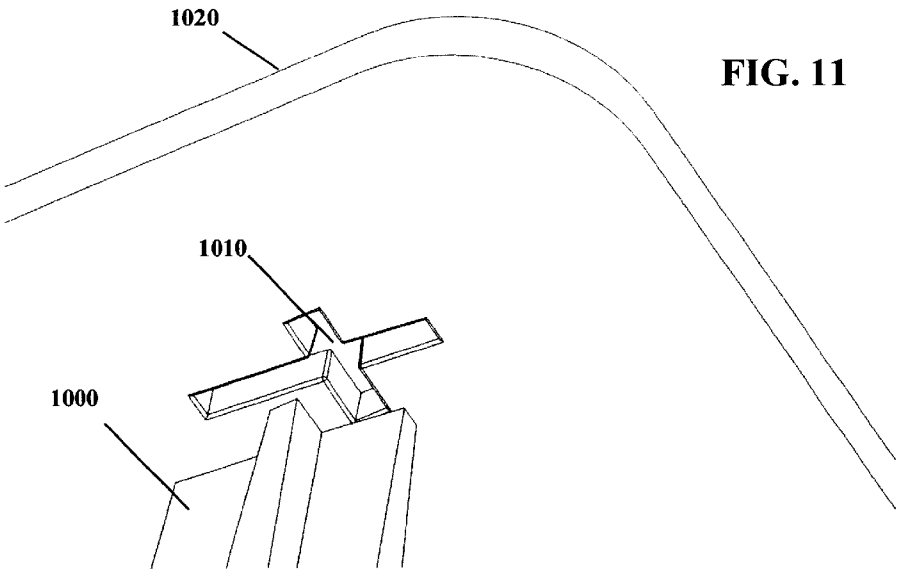
FIG. 10 and FIG. 11 depict yet another embodiment of a stop which may be used in the light fixture assembly of FIG. 1.
Figure 10:
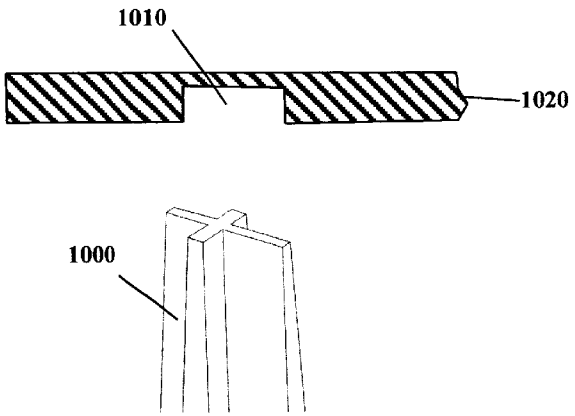

FIGS. 10 and 11 show a further alternative embodiment of a shaped protrusion stop 270. A cross-shaped protrusion stop 1000 extends from the fixture housing 120 to a mating recessed portion 1010 in the module tray 1020. This prevents movement in the X, Y and negative Z directions.

Referring to FIGS. 3–5 and FIGS. 12 and 13, an exemplary releasable catch 265 is depicted as a flexible clip 1200 with clip notches 1210 on its side ends. The width of clip notches 1210 is sufficient to substantially correspond to the thickness of the module tray 200. The releasable catch 265 may also have a curved top end surface 1220 sufficient for pressing down to release the electrical component module 110 from the substantially stationary position. The curved top end surface 1220, which also functions as a lead in for the releasable catch, springs back automatically as the electrical component module 110 is placed into the fixture housing 120, thereby making it unnecessary for the releasable catch 265 to be manually pushed out of the way. The width of the notch 260 of the module tray 200 is substantially equal to the space between the clip notches 1210 in the releasable catch 265.

The releasable catch 265 interconnects with a side end of the module tray 200 to prevent the electrical component module 110 from moving in the X and Z directions. The releasable catch 265 may be attached to the interior of the fixture housing 120 using a variety of attachment means, such as screws or other fasteners. The releasable catch 265 may also be molded into the fixture housing 120.

Figure 14:
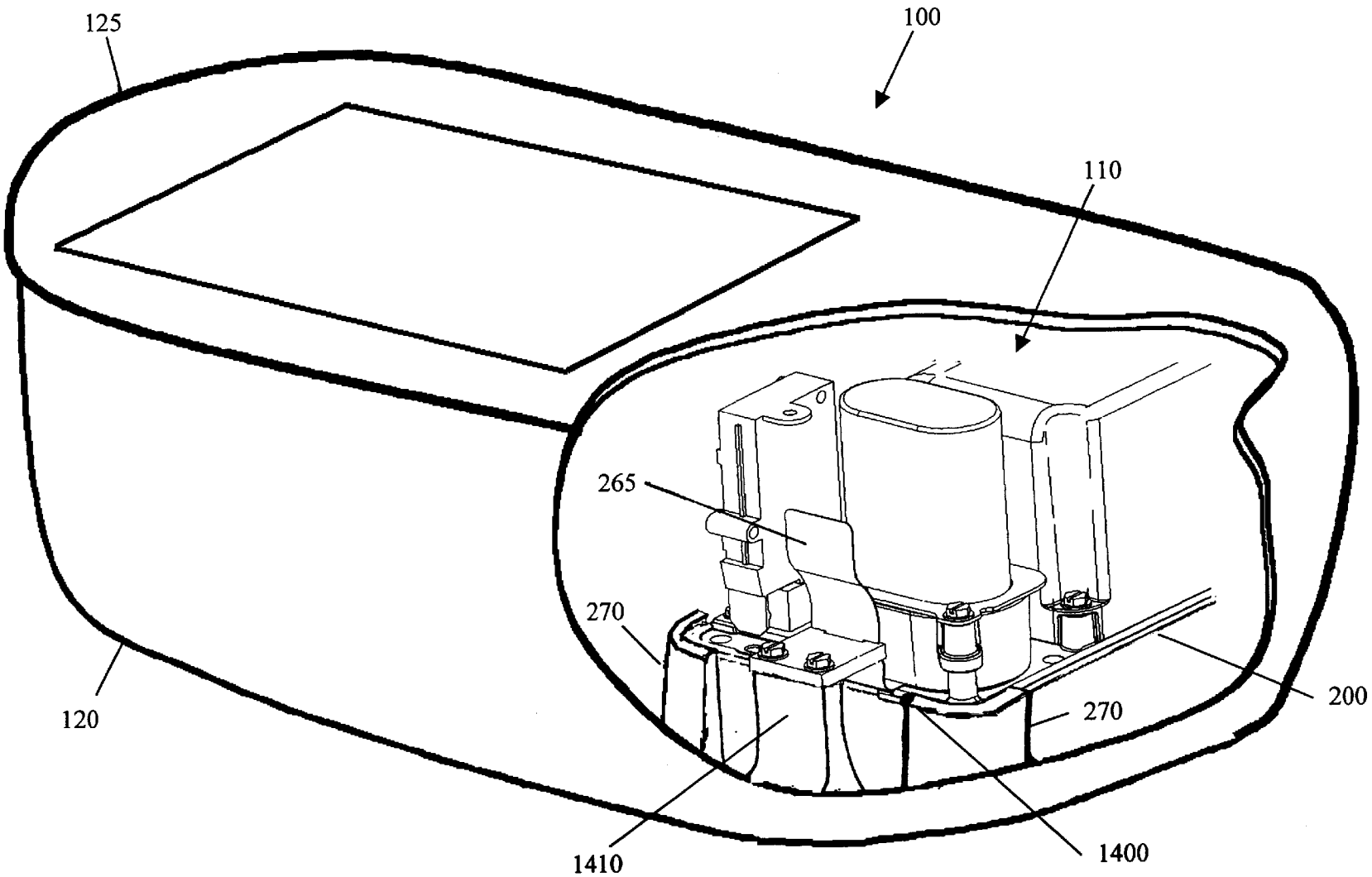
FIG. 14 depicts an alternative embodiment of the releasable catch used in the light fixture assembly of FIG. 1.

In an alternative embodiment, the releasable catch 265 may be attached to or molded into the module tray 200, as in FIG. 14. The releasable catch 265 interconnects with a mating cavity 1400 attached to a catch protrusion 1410 extending from the fixture housing 120. When engaged, the releasable catch 265 prevents the electrical component module 110 from moving in the X and Z directions. Alternatively, the mating cavity 1400 may be molded into the fixture housing 120.

The releasable catch 265 may also be a clip with a cavity, wherein a mating portion of module tray 200 engages the cavity. The releasable catch 265 may further be a hook which overlaps a portion of the module tray 200 and holds the module tray 200 in place.

Figure 15:
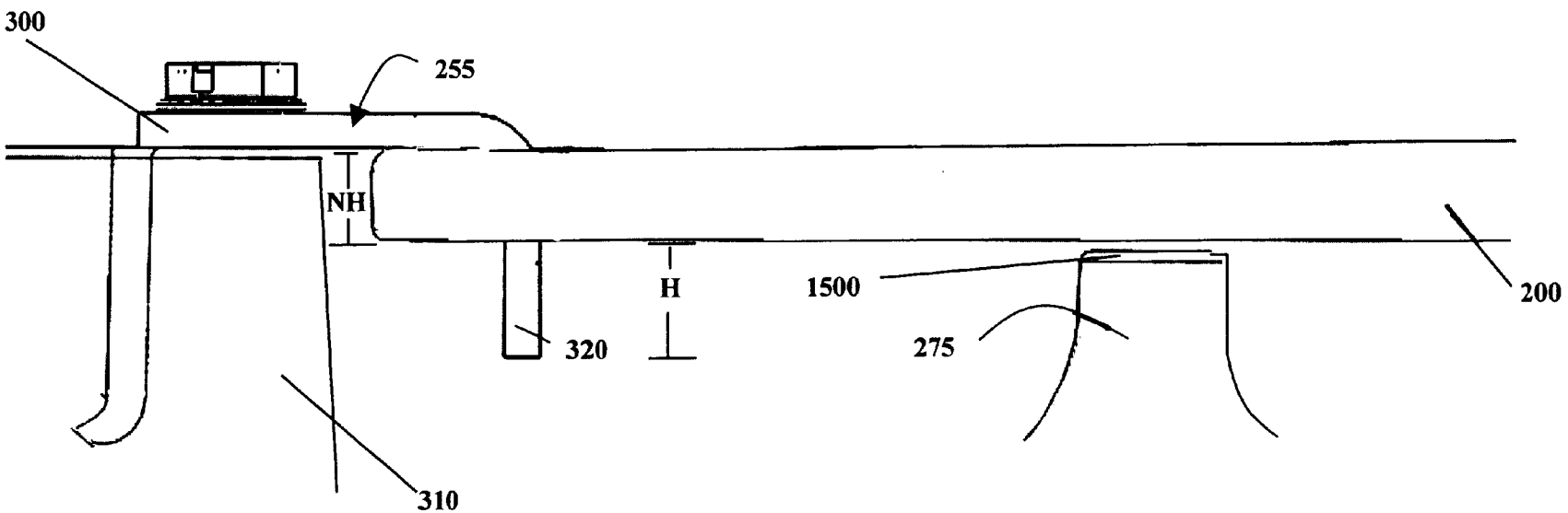
FIG. 15 depicts an enlarged side view of the housing focusing on the pivot element and bracket used in the light fixture assembly of FIG. 1.

Referring to FIGS. 3–5, the fixture housing 120 may also contain at least one pivot element 275, which preferably has a flat surface at the top end 1500, against which the module tray 200 may rest. The pivot element 275 is located between the bracket 255 and the stops 270 and is preferably towards the area where the heavier components of the electrical component module 110 would sit when the electronic component module 110 is placed into the fixture housing 120. In order to provide greater support for the electrical component module 110, the unattached portion 320 of the bracket 255 may overlap the top end 1500 of the pivot element 275 a predetermined height H, as shown in FIG. 15. This prevents the electrical component module 110 from falling out when the module tray 200 is released by the releasable catch 265. This feature is particularly useful when the light fixture assembly 100 faces downward. It is preferable that the non-overlapping portion, shown as height NH, be substantially equal to the thickness of module tray 200. The pivot element 275 may be attached to the fixture housing 120 or may be molded into the fixture housing 120. The pivot element 275 prevents movement of the electrical component module 110 in the negative Z-direction. The pivot element 275 may take any number of shapes, such as a cylinder or square. The module tray 200 may rest against top end 1500 of the pivot element 275. In an alternative embodiment, the module tray 200 may also contain a recessed portion which interconnects with the pivot element 275 (similar to one alternative embodiment of the stop 270, as shown in FIGS. 10 and 11).

To mount the electrical component module 110 in the fixture housing 120, the bracket 255 is inserted through the bracket cavities 250 of the module tray 200. The electrical component module 110 is then swung into place. The ends of the module tray 200 are then pressed into the stops 270 and the releasable catch 265 until the releasable catch 265 is engaged and an audible snap is heard. This audible snap confirms that the electrical component module 110 is securely in place.

To remove the electrical component module 110 from the fixture housing 120 in one embodiment, the top end surface 1220 of the releasable catch 265 is pressed away from the center of the electrical component module 110 until the end of module tray 200 secured by the releasable catch 265 is released from the fixture housing 120. The electrical component module 110 is then removed from the fixture housing 120 by tilting the end of the module tray 200 held by the bracket 255 down into the fixture housing 120 until the bracket 255 passes through the bracket cavities 250 of the module tray 200. The electrical component module 110 is then released completely from the fixture housing 120.

Figure 16:
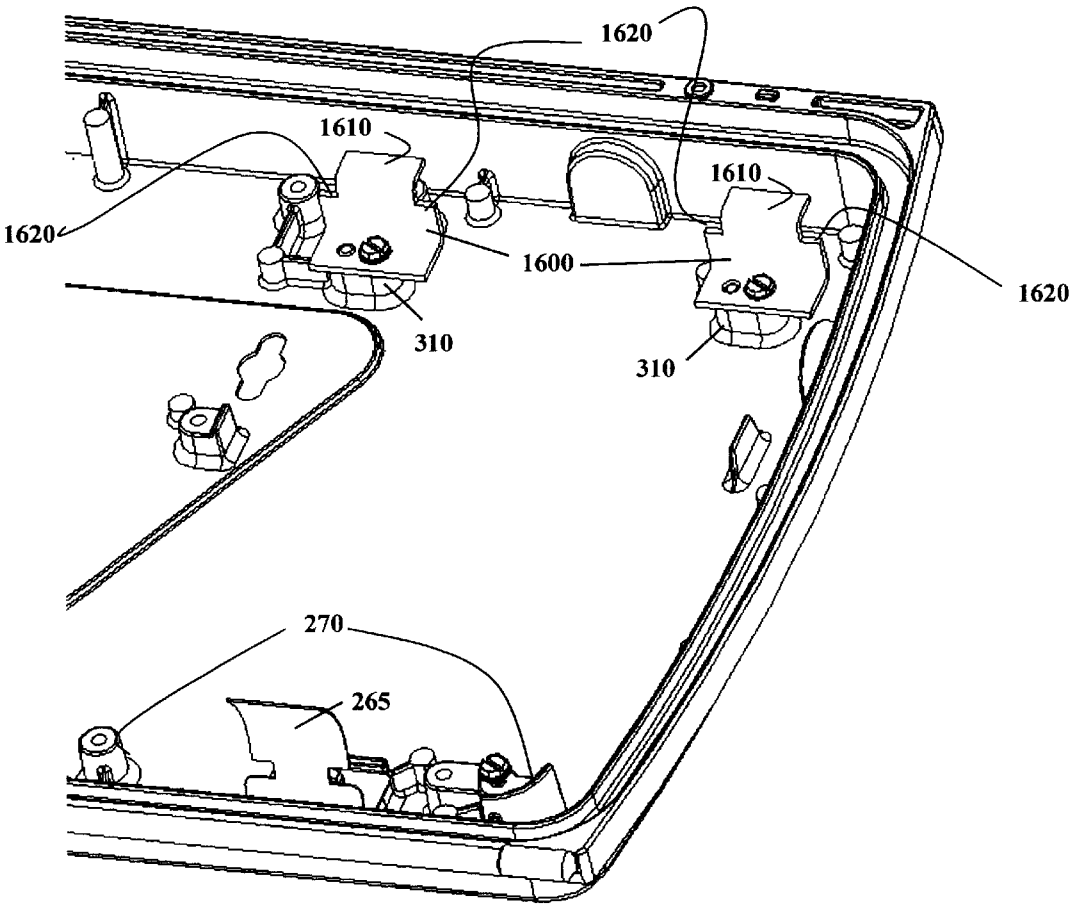
FIG. 16 shows a top view of a second embodiment of a light fixture assembly embodying the present invention.

FIG. 16 depicts another embodiment of a light fixture assembly embodying the present invention. In this embodiment, multiple brackets 1600 are depicted as reversed hook brackets. The brackets 1600 are attached to the bracket protrusions 310 such that the hook portion 1610 of the brackets 1600 are curved upward.

Electrical component module 110 is inserted in fixture housing 120 by inserting the reversed hook brackets 1600 through the bracket cavities 250 of the module tray 200. The reversed hook brackets 1600 function to prevent movement in the X, Y and positive Z-directions. The reversed hook brackets 1600 also function as pivot elements to prevent movement of electrical component module 110 in the negative Z-direction. This functionality is accomplished because the module tray 200 rests on upright sides 1620 of the reversed hook brackets 1600. One limitation of this embodiment, however, is that the electrical component module 110 may fall out during a disassembly of the light fixture assembly when the light fixture assembly is faced downward.

In summary, embodiments of the invention provide an efficient system and method for mounting modules in a light fixture assembly without requiring additional hardware on the electrical component module. Tools are not required to place or remove the electrical component module. The electrical component module is prevented from falling out of the fixture housing when the light fixture assembly faces downward.

Furthermore, since numerous modifications and variations will readily occur to those skilled in the art, the present invention is not limited to the exact construction and operation illustrated and described herein. Accordingly, all suitable modifications and equivalents which may be resorted to are intended to fall within the scope of the claims.

What is claimed is:

1. A light fixture having a module insertable into a fixture housing, said module capable of being held in a substantially stationary position, comprising:

(a) at least one bracket attached to said fixture housing;

(b) at least one stop contained in said fixture housing, said stop being opposed to said bracket, and said stop being a raised portion of said fixture housing which receives said module; and (c) a releasable catch attached to said fixture housing for holding said module in said stationary position, the spacing between said bracket and said stop being sufficient to accommodate fitted placement of said module in said stationary position.

2. The light fixture of claim 1, wherein said module has at least one notch on a side end for interconnecting with said releasable catch.

3. The light fixture of claim 1, wherein said releasable catch is a clip having two opposing notches of complementary thickness to a side end of said module.

4. The light fixture of claim 1, wherein said stop is conical shaped.

5. The light fixture of claim 1, wherein said raised stop portion is a wall of said fixture housing for receiving said module.

6. The light fixture of claim 1, wherein said raised stop portion is a protrusion of said fixture housing for receiving a recessed portion on said module.

7. The light fixture of claim 1, wherein said bracket is L-shaped.

8. The light fixture of claim 1, wherein said bracket is Z-shaped.

9. The light fixture of claim 1, wherein said bracket is a hook facing away from said fixture housing.

10. The method according to claim 1, wherein the configuration arrangement between the module and the releasable catch result in the generation of an audible snap to confirm engagement between the module and the releasable catch.

11. The light fixture assembly according to claim 1 wherein the at least one bracket includes an unattached portion which overlaps a top end of the at least one pivot element by a predetermined height, to prevent the module from falling out when the module tray is released by the releasable catch.

12. The light fixture of claim 1, further comprising at least one pivot element contained in said fixture housing and placed between said stop and said bracket, said pivot element having a top end which rests against said module.

13. The light fixture of claim 12, wherein said pivot element is attached to said housing.

14. The light fixture of claim 12, wherein said pivot element is a raised portion of said housing.

15. The light fixture of claim 12, wherein said pivot element is incorporated into said bracket.

16. A light fixture having a module insertable into a fixture housing, said module capable of being held in a substantially stationary position, comprising:

(a) at least one bracket attached to said fixture housing;

(b) at least one stop contained in said fixture housing, said stop being opposed to said bracket; and (c) a releasable catch attached to said fixture housing for holding said module in said stationary position, the spacing between said bracket and said stop being sufficient to accommodate fitted placement of said module in said stationary position, wherein said module has a mating recessed portion for receiving said stop.

17. The light fixture of claim 16, wherein said recessed portion is a cavity.

18. The light fixture assembly according to claim 16 wherein the at least one bracket includes an unattached portion which overlaps a top end of the at least one pivot element by a predetermined height, to prevent the module from falling out when the module tray is released by the releasable catch.

19. A light fixture assembly comprising:

(a) a fixture housing including, (i) at least one bracket of the fixture housing, (ii) at least one stop of the fixture housing, the at least one stop being located distant from the at least one bracket, (iii) a releasable catch of the fixture housing, and (iv) at least one pivot element of the fixture housing;

(b) an electrical component module including, (i) a module tray with at least one bracket cavity, the module tray configured to, engage the at least one bracket, to limit movement of the module tray in X, Y, and positive Z directions, engage the releasable catch to limit movement of the module tray in the X, Z directions, engage the at least one stop to limit movement of the module tray in at least one of the X and negative Y and Z directions or the X and Y and negative Z directions, and engage the at least one pivot element to limit movement of the module tray in the negative Z direction, wherein the engagement and a disengagement between the module tray and the at least one bracket, the at least one stop, the releasable catch, and the at least one pivot element is accomplished in a tool-less fashion, and wherein the X direction is horizontal to ground within a plane, Y is vertical to ground within the plane, and Z is in a direction through the plane.

20. The light fixture assembly according to claim 19 wherein the at least one bracket includes an unattached portion which overlaps a top end of the at least one pivot element by a predetermined height, to prevent the module from falling out when the module tray is released by the releasable catch.

* * * * *